US012378754B2

(12) United States Patent
Su

(10) Patent No.: US 12,378,754 B2
(45) Date of Patent: Aug. 5, 2025

(54) QUICK INSTALLATION AND RELEASE NUT

(71) Applicant: Guangdong Meijie Faucet Company Limited, Dongguan (CN)

(72) Inventor: Zaijiang Su, Dongguan (CN)

(73) Assignee: GUANGDONG MEIJIE FAUCET COMPANY LIMITED, Dongguan (CN)

( * ) Notice: Subject to any disclaimer, the term of this patent is extended or adjusted under 35 U.S.C. 154(b) by 8 days.

(21) Appl. No.: 18/612,225

(22) Filed: Mar. 21, 2024

(65) Prior Publication Data

US 2024/0352717 A1 Oct. 24, 2024

Related U.S. Application Data

(60) Provisional application No. 63/454,434, filed on Mar. 24, 2023.

(51) Int. Cl.
*E03C 1/04* (2006.01)

(52) U.S. Cl.
CPC ..... *E03C 1/0401* (2013.01)

(58) Field of Classification Search
CPC ..... E03C 1/0401; E03C 1/0402; E03C 2001/0416; F16B 37/0857; F16B 37/0864
See application file for complete search history.

(56) References Cited

U.S. PATENT DOCUMENTS 5,902,085 A * 5/1999 Yuta ..... F16B 37/0857 411/908
10,428,496 B1 * 10/2019 Lu ..... E03C 1/0403
11,644,060 B2 * 5/2023 Ma ..... F16B 37/0864 411/433
2023/0075627 A1 * 3/2023 Wang ..... E03C 1/0401
2023/0081301 A1 * 3/2023 Romero ..... E03C 1/0402 4/678

* cited by examiner

*Primary Examiner* — Reinaldo Sanchez-Medina
(74) *Attorney, Agent, or Firm* — Ware, Fressola, Maguire & Barber LLP; Brian L. Wamsley

(57) ABSTRACT

A quick installation and release nut for a faucet includes a main body, a receiving assembly on the upper portion of the main body, a press plate which is movably disposed on the receiving assembly, and at least two movable lock blocks disposed in the receiving assembly, is disclosed. The press plate comprises at least one vertically oriented diagonal slide for each of the movable lock blocks. The at least two movable lock blocks comprise an inner wall having internal threads corresponding to the threads of a threaded rod, and an outer wall having vertically oriented diagonal slide grooves for slidably receiving the vertically oriented diagonal slides of the press plate. When the press plate is depressed, the diagonal slides of the press plate, in conjunction with the diagonal grooves in the lock blocks cause the lock blocks to move inwardly towards the axis of the threaded rod until the lock blocks engage the external threads of the threaded rod. The installation nut is locked into position by rotating it clockwise.

10 Claims, 7 Drawing Sheets

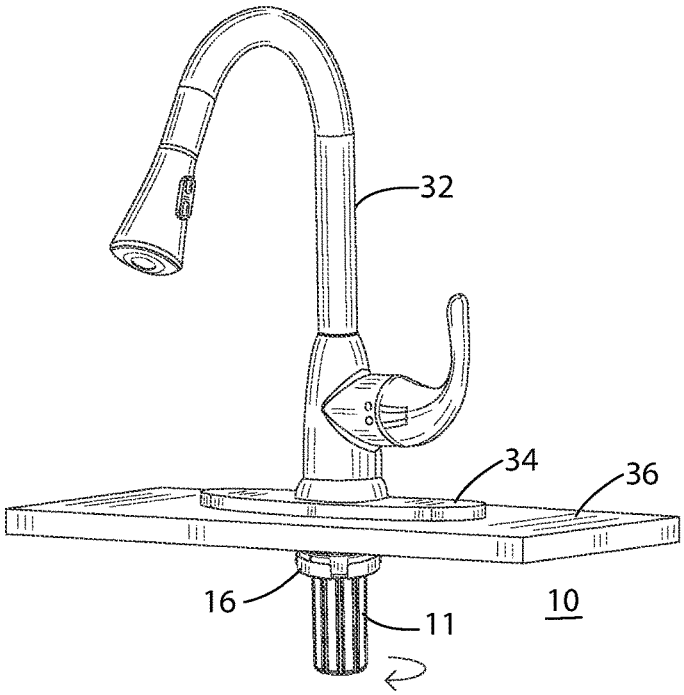
FIG. 9a
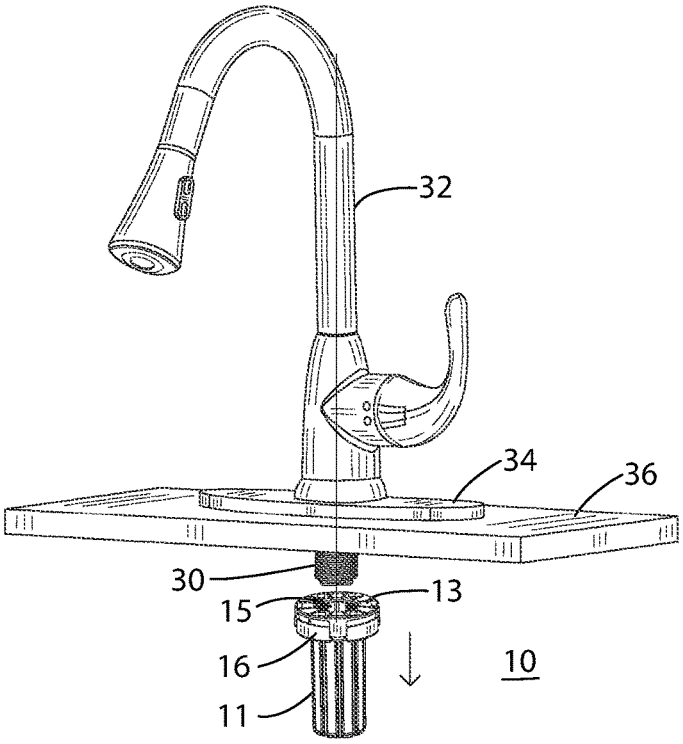
FIG. 9b
FIG. 9

QUICK INSTALLATION AND RELEASE NUT

This application claims priority to U.S. provisional application Ser. No. 63/454,434, filed Mar. 24, 2023.

BACKGROUND

The present invention relates to a quick installation and release mechanism, and more particularly to a quick installation and release nut for a faucet or other related kitchen or bathroom assembly.

When a faucet is installed at one side of a kitchen or bathroom sink, a threaded nut is used to mesh with the threaded bolt, or rod, at the lower end of the faucet so that the faucet can be installed on the countertop. The faucets of the kitchen and bathroom are installed close to the wall and are limited by a shape of a stainless steel or ceramic sink such that the space under the countertop to lock the faucet, between the sink and the wall, is very small. According to the traditional operation to lock the threaded nut on the threaded bolt, the threaded nut must be rotated from the lower end of the threaded bolt. The length of the threaded bolt depends on the thickness of the countertop, namely, it determines the route of the threaded nut to become locked. Thus, to lock or unlock the threaded nut takes time and energy.

In order to install the faucet quickly, a quick installation nut assembly structure is developed on the market. This structure achieves quick installation through a one-way engagement to secure the faucet. However, when dismounted, the nut must be dismounted from the highest position from the distal end of the bolt. This also takes time and energy because the space under the countertop is narrow. A simpler, more effective quick nut installation is desired. Accordingly, the simpler, more effective quick installation nut of the present invention solves many of these problems.

SUMMARY OF THE INVENTION

The present disclosure provides an installation nut intended to solve the deficiencies of the existing technical problems in installing faucets. The primary object of the present invention is to provide a quick installation and disassembly mechanism for installing a faucet and its related parts quickly and conveniently.

It is a further object of this invention to provide a quick installation nut that requires minimal manual manipulation in installation and removal.

It is also an object of this invention to provide an installation nut that can be operated in confined spaces.

It is an additional object of this invention to provide an installation nut that can be easily locked onto a threaded bolt and easily released.

In order to achieve the aforesaid objects, the quick installation nut of the present invention, cooperating with a threaded bolt at the lower portion of a faucet or other parts, comprises a main body, a receiving assembly positioned at the top of the main body, a press plate which is movably disposed on the receiving assembly, and at least two lock blocks which are movably disposed within the receiving assembly and are driven by the press plate. The press plate is an annular plate. Each of the at least two movable lock blocks comprise an inner wall having internal threads corresponding to external threads on the outer wall of a threaded bolt. The movable lock blocks are driven by the press plate to an inner position which causes the installation nut to become locked onto the bolt. The movable lock blocks are further composed of at least one elastic member on each of the at least two movable lock blocks to return the movable lock blocks to an outward position when the press plate is released. The lower surface of the press plate is movably inserted in the main body. The lower surface of the press plate also comprises vertically oriented diagonal slides, which are in touch with the movable lock blocks. Specifically, the vertically oriented diagonal slides on the lower surface of the press plate are designed to be slidably inserted into corresponding vertically oriented diagonal grooves in the movable lock blocks, such that, when the press plate is depressed, the downward motion of the press plate causes the diagonal slides to move downwardly within the diagonal grooves in the movable lock blocks causing the movable lock blocks to move inwardly towards the axis of the threaded nut until the internal threads of the movable blocks mesh tightly with the external threads of a faucet bolt. The installation nut is installed by pressing the main body upward to surround the threaded bolt until the press plate is pushed downwards and activates the lock block to move inwardly to connect with the threaded nuts of the threaded bolt. The installation nut is further locked into position by rotating the main body in a clockwise direction. The installed nut can be released from the threaded bolt by rotating the main body in a counterclockwise direction and pulling it downward.

In a preferred embodiment the press plate defines an annular structure.

In a preferred embodiment the installation nut further comprises an elastic reset member, one end of which abuts the underside of the press plate and the other end is inserted into a movable lock block.

In a preferred embodiment the press plate further comprises vertically oriented diagonal slides for insertion into vertically oriented diagonal grooves of the lock blocks.

In a preferred embodiment the at least two lock blocks comprise vertically oriented diagonal grooves for insertion of the vertically oriented diagonal slides of the press plate.

In a preferred embodiment the vertically oriented diagonal grooves of one lock block and the corresponding vertically oriented diagonal slides of the press plate extend in opposite directions to the vertically oriented diagonal grooves of an opposite second lock block and the corresponding vertically oriented diagonal slides of the press plate for that second lock block.

BRIEF DESCRIPTION OF THE DRAWINGS

The features, objects, and advantages of the invention will appear and can be further understood by reference to the following drawings.

FIG. 9*a* illustrates a perspective view of an embodiment of an installation nut of the within invention being released after installation; and FIG. 9*b* illustrates a perspective view of an embodiment of an installation nut of the within invention being uninstalled after being released.

DETAILED DESCRIPTION OF THE INVENTION

Embodiments of the present invention will now be described, by way of example only, with reference to the accompanying drawings.

Figure 1:
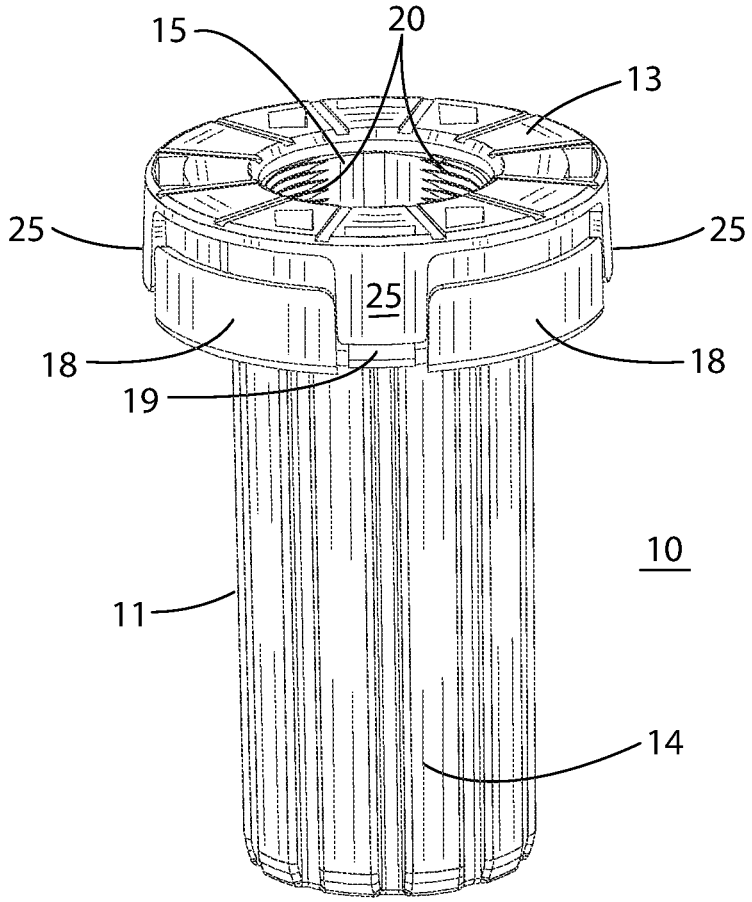
FIG. 1 illustrates a perspective view of an embodiment of an installation nut of the within invention.
Figure 2:
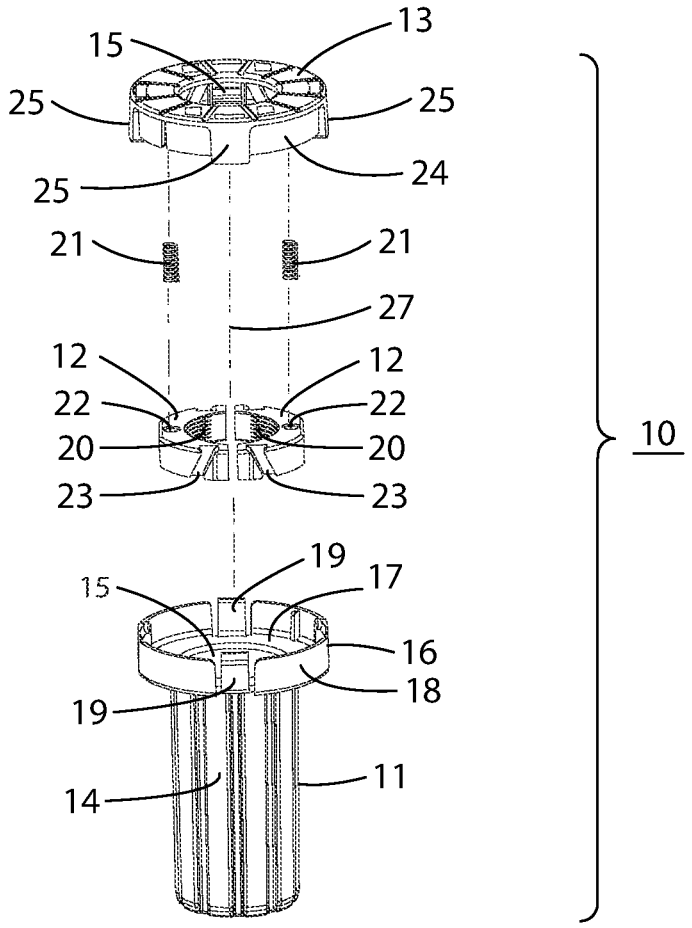
FIG. 2 illustrates an exploded view of the embodiment of the installation nut of FIG. 1.

As shown in FIGS. 1 and 2, the present invention discloses a quick installation and release mechanism, or nut, for installing a faucet and its related parts. The installation and release nut is movably fitted on the threaded bolt, or rod, at the lower portion of a faucet on the kitchen sink or bathroom sink on the counter top. See FIG. 8. The nut 10 comprises a main body 11, a receiving assembly 16, and two movable lock blocks 12 disposed opposite to each other within the receiving assembly 16 of the main body 11, a press plate 13, which is movably attached to the main body 11 that drive lock blocks 12 together when press plate 13 is depressed.

The outer wall of the main body 11 comprises a vertical ribbed portion 14 for gripping the main body 11 and applying a rotational or upward vertical force. The main body 11 has a central receiving cavity 15 passing through it. The upper portion of the receiving cavity 15 is formed with receiving assembly 16 to accommodate movable lock blocks 12. Receiving assembly 16 is composed of a flat portion, or seat, 17 on which movable blocks 12 are positioned, vertical side walls 18 for enclosing the flat seat 17, and vertical tabs 19 for connecting with and securing press plate 13 when press plate 13 is movably disposed on the main body.

Figure 3:
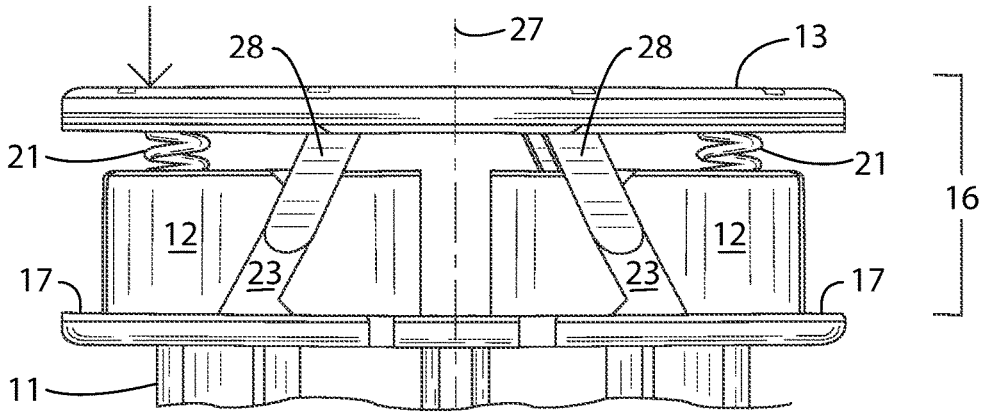
FIG. 3 illustrates a cut-away view of the top of the embodiment of the installation nut of FIG. 1.

The inner wall of each movable lock block 12 is formed with a threaded surface 20 corresponding to the outer wall threaded surface of faucet bolt 30. Each movable lock block 12 is also provided with at least one elastic member in the form of a spring 21, which is inserted in holes 22 located at the top of each movable lock block 12 for connection with press plate 13 in returning the movable lock blocks 12 to an open position when press plate 13 is released. (See FIG. 3). The outer wall of each movable lock block 12 is comprised of vertically oriented diagonal slide grooves 23 for connection and interaction with press plate 13, as illustrated in FIG. 3. Diagonal slide grooves 23 extend downward beginning at the tops of movable lock blocks 12 at angles directed away from the centerline 27 of the installation nut 10.

Press plate 13 is an annular plate, and is composed of a circumferential lower portion 24, at least two tabs 25 for locking the press plate 13 when the installation nut 10 is fully engaged, and at least two tabs 26 for movably securing press plate 13 on the main body 11. In assembling installation nut 10, lower portion 24 of press plate 13 is movably inserted within the vertical side walls 18 at the top of the main body 11, while tabs 26 of press plate 13 interconnect with vertical tabs 19 of the main body 11. Such interconnection allows for the movable attachment of press plate 13 to main body 11. See FIGS. 7*a* and 7*b*.

Figure 4:
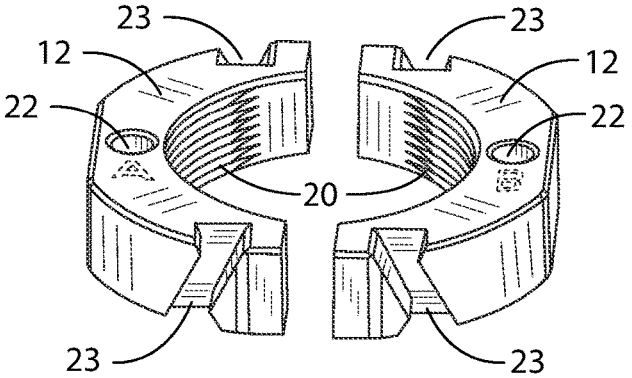
FIG. 4 illustrates a perspective view of two movable lock blocks of an embodiment of an installation nut of the invention.
Figure 5:
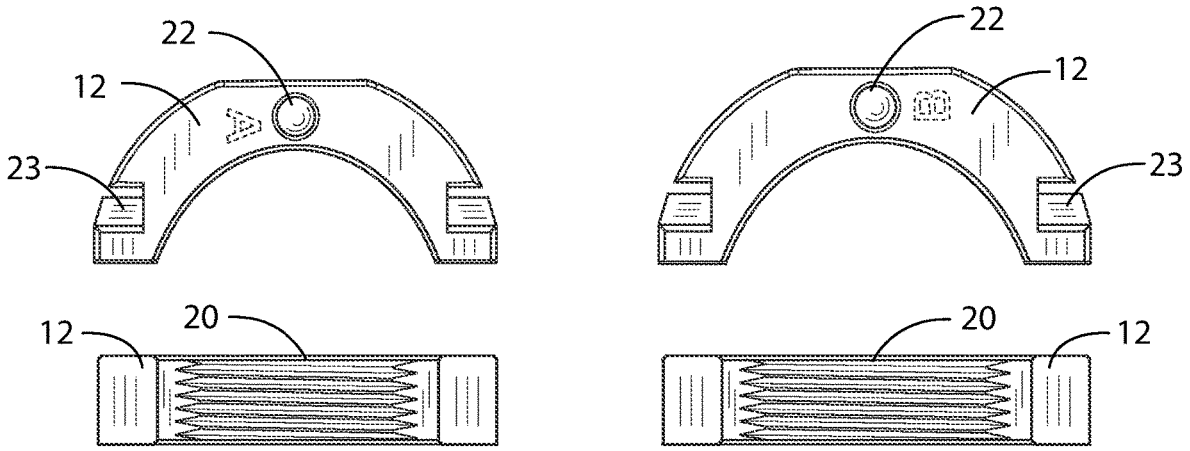
FIG. 5 illustrates top and internal views of the two movable lock blocks of FIG. 4.

Referring now to FIGS. 3-5, FIG. 3 illustrates an internal view of receiving assembly 16 and the movable attachment of press plate 13 to the top part of main body 11 where vertical side walls 18 of receiving assembly 16 have been removed. FIGS. 4 and 5 provide closer illustrations of movable lock blocks 12, which are oppositely disposed in an "open" position. As shown in FIG. 3, the two movable lock blocks 12 rest on flat seat 17 of main body 11. Springs 21 extend from the tops of movable lock blocks 12 to the underside of press plate 13. Springs 21 are located in vertical holes 22, at least one in each lock block, although it is within the scope of this invention that each lock block 12 may have more than one spring 21. Holes 22 do not extend through the entire height of lock blocks 12, such that springs 22 do not extend through lock blocks 21 to rest on flat seat 17. See FIGS. 7*a* and 7*b*.

When placed side-by-side, movable lock blocks 12 are identical in design, but when placed facing each other within receiving assembly 16 they become mirror images of each other (see FIG. 4). Accordingly, when placed facing each other within receiving assembly 16, diagonal slide grooves 23 of lock blocks 12 extend downward and in opposite directions as seen in FIGS. 3 and 4.

As also illustrated in FIG. 3, press plate 13 is composed of downward facing diagonal slides 28 that extend away from each other. Diagonal slides 28 are configured to be slidably inserted into slide grooves 23 of movable lock blocks 12 when press plate 13 is movably connected to main body 11. Thus, in the embodiment shown, there are a total of four diagonal slides 28, i.e., two for each movable block 12, said diagonal slides 28 configured in the direction necessary to coincide with the direction of slides grooves 23 in each movable lock block 12.

Figure 6A:
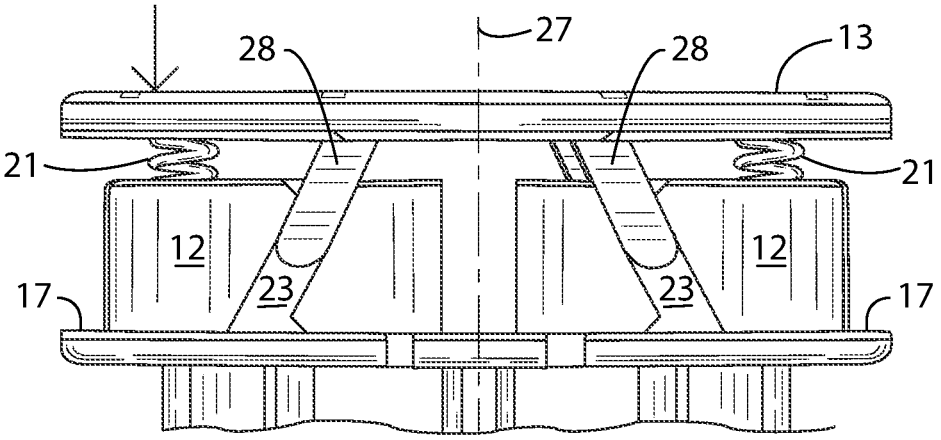
FIG. 6*a* illustrates an internal view of the top of an embodiment of the installation nut of the invention where the outer sides of the top has been removed, showing an opened position of the two movable lock blocks prior to installation.
Figure 6B:
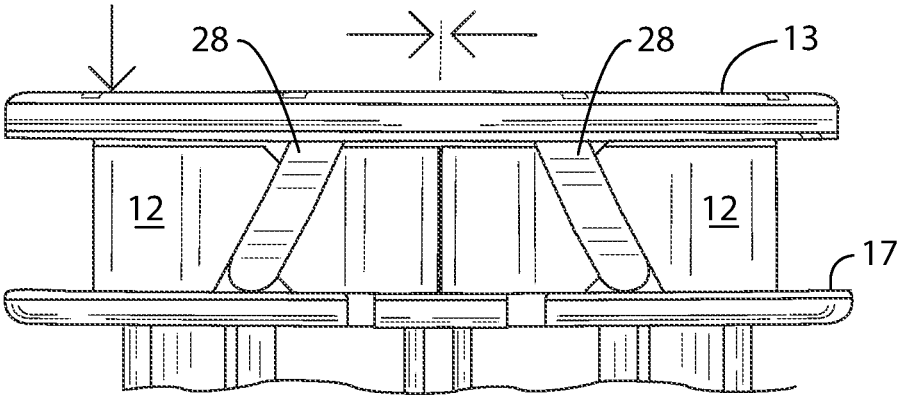
FIG. 6*b* illustrates an internal view of the top of an embodiment of the installation nut of the invention where the outer sides of the top has been removed, showing a closed position of the two movable lock blocks after installation.
Figures 7, 7A, 7B:
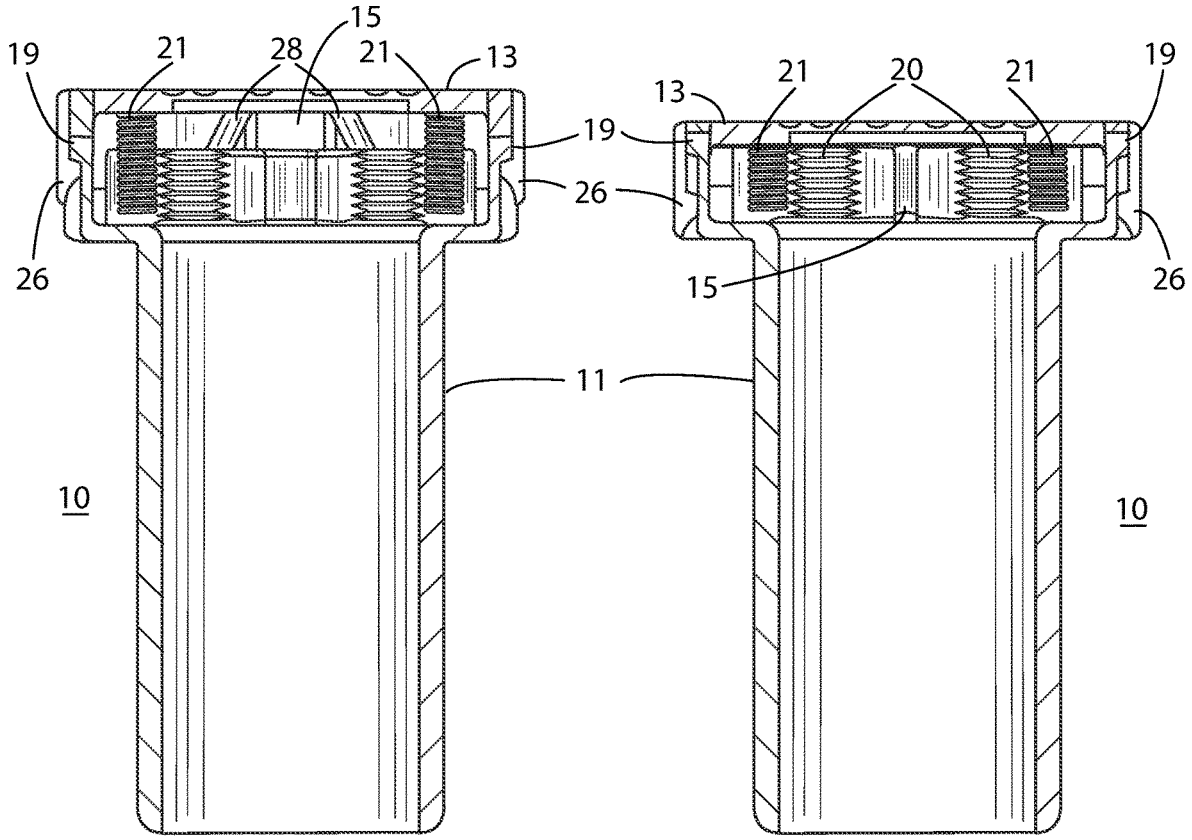
FIG. 7*a* illustrates a cross-sectional view of an embodiment of the installation nut of the invention, showing the opened position of the two movable lock blocks prior to installation.
FIG. 7*b* illustrates a cross-sectional view of an embodiment of the installation nut of the invention, showing the closed position of the two movable lock blocks after installation.

The operation of installation nut 10 is shown by FIG. 6, where 6*a* illustrates where movable lock blocks 12 are spaced apart in an "open" position, and 6*b* illustrates where movable lock blocks 12 are moved together in a "closed" position, in the directions shown by the arrows. When installation nut 10 is pushed vertically upward against the underside of a countertop, downward pressure, as indicated by the arrow, is placed on press plate 13 causing diagonal slides 28 to also move downwardly within slide grooves 23. Because slides 28 and slide grooves 23 within each of the two movable lock blocks 12 are angled oppositely and away from each other, downward motion of slides 28 causes the two movable lock blocks 12 to move together laterally from the open to the closed position. Accordingly, springs 21 in each of movable lock blocks 12 move together along with movable lock blocks 12, as seen in FIG. 7. Springs 21 thus slide laterally along the underside of press plate 13 when press plate 13 is moved downwardly. When the downward motion is complete, the inner surface 20 of movable lock blocks 12 will have connected with the outer threaded surface of the faucet bolt 30 (FIG. 8), and press plate 13 becomes locked into position by tabs 25 interconnecting with tabs 19.

Similar to FIG. 6, FIG. 7 illustrates by cross-sectional views the operation of installation nut 10. FIG. 7*a* illustrates where press plate 13 is in an upward, pre-installation position and where movable lock blocks 12 are spaced apart in an "open" position. Here, the interconnection of vertical tabs 19 with tabs 26 can be seen, such interconnection securing press plate 13 in movable attachment with body 11. FIG. 7*b* illustrates where press plate 13 has been depressed downwardly in an installed position, such that movable lock blocks 12 are moved together in a "closed" position. Springs 21 in each of movable lock blocks 12 are shown to have moved laterally together along with movable lock blocks 12, and can be seen to be in different positions in FIGS. 7*a* and 7*b*. In the closed position of FIG. 7*b*, the inner surfaces 20 of movable lock blocks 12 have connected with the outer threaded surface of the faucet bolt 30 (not shown), and press plate 13 becomes locked into position by tabs 25 (not shown).

Figure 8A:
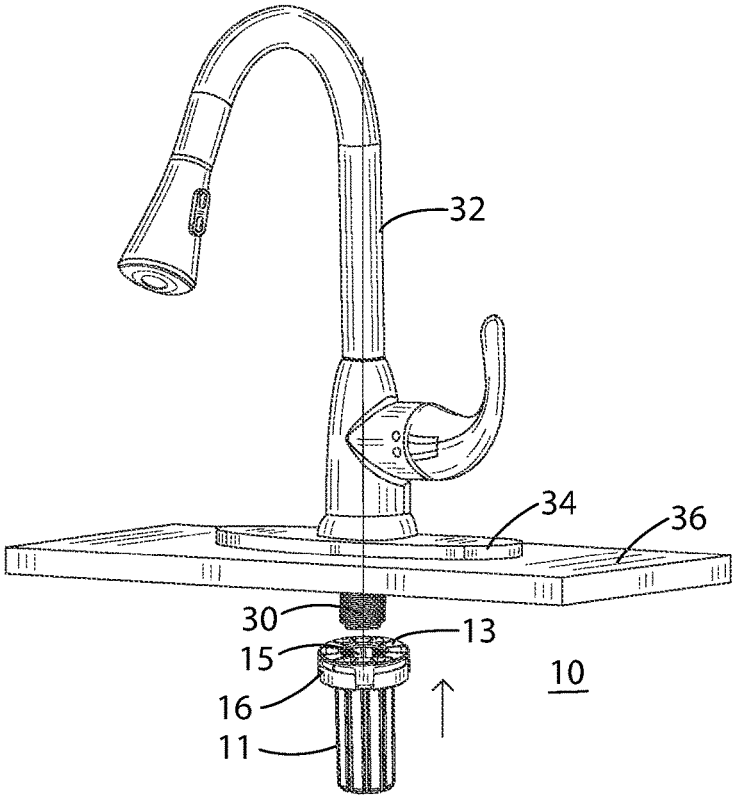
FIG. 8*a* illustrates a perspective view of an embodiment of an installation nut of the within invention being installed.
Figure 8B:
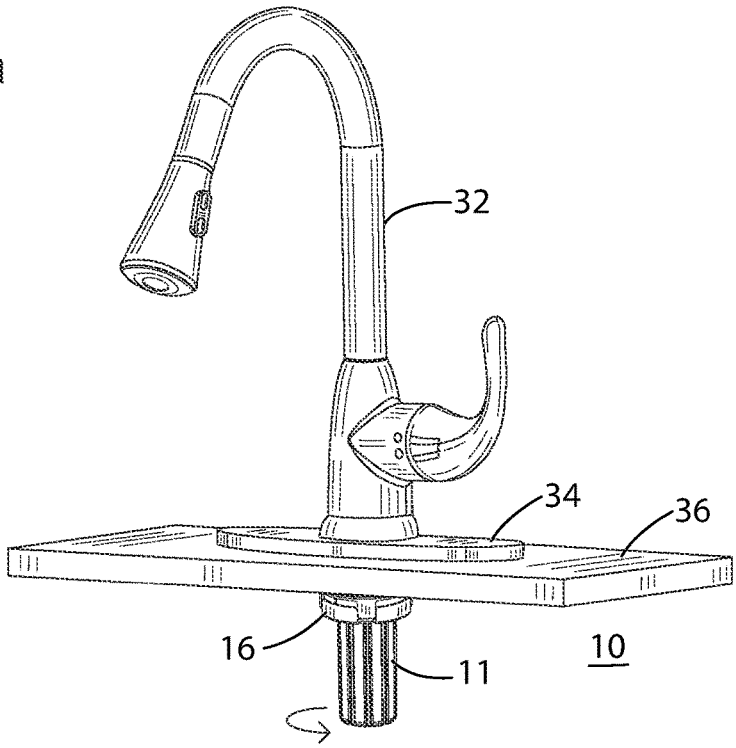
FIG. 8*b* illustrates a perspective view of an embodiment of an installation nut of the within invention upon being locked after installation.

FIGS. 8*a* and 8*b* illustrate the quick and easy installation of installation nut 10 to install faucet 32 on countertop 36. Faucet 32 comprises a flat plate 34, which rests faucet 32 on countertop 36, and faucet bolt 30 which extends downwardly through countertop 36 and provides an attachment point for installation nut 10. Installation nut 10 is positioned below faucet bolt 30 such that faucet bolt 30 can be inserted into receiving cavity 15 when installation nut 10 is moved vertically upward in the direction of the arrow. Nut 10 can be further secured by locking it into position by manually rotating nut 10 in a clockwise direction, as shown. To quickly remove installation nut 10, installation nut 10 is manually rotated counterclockwise as shown in FIG. 9*a*, which releases press plate 13 and allows lock blocks 21 to return to their original positions within receiving assembly 16. Installation nut 10 is thus released from faucet bolt 30 and can be removed by pulling down on nut 10 in the vertical direction shown.

The preceding preferred embodiments are illustrative of the practice of the invention. It will be apparent to those skilled in the art that various modifications and variations can be made in the present disclosure without departing from the spirit or scope of the invention. Thus, it is intended that the present disclosure cover the modifications and variations of this invention provided they come within the scope of the appended claims and their equivalents.

What is claimed is:

1. An installation nut configured to thread with a threaded bolt, comprising:

a main body comprising a through hole, a receiving assembly positioned at the top portion of said main body, a press plate disposed at the top of said main body and movably connected with said receiving assembly, said press plate further comprising at least one vertically oriented diagonal slide, at least two movable lock blocks oppositely disposed on a flat seat within said receiving assembly, said at least two movable lock blocks each comprising an inner wall having an internal thread, and an outer wall having vertically oriented diagonal slide grooves for slidably receiving said vertically oriented diagonal slides of said press plate, and at least one elastic member for connection of each of said at least two movable lock blocks with an underside of said press plate, wherein when said press plate is depressed, the diagonal slides of said press plate, in conjunction with said diagonal slide grooves in each of said movable lock blocks cause said movable lock blocks to move inwardly towards the axis of said threaded bolt, and wherein said installation nut is installed on said threaded bolt by positioning said threaded bolt with said through hole of said main body and applying upward pressure to said main body until said press plate contacts an underside of a countertop resulting in downward pressure on said press plate such that said lock blocks are moved inwardly until said lock blocks engage external threads of said bolt.

2. The installation nut according to claim 1, wherein said press plate defines an annular structure.

3. The installation nut according to claim 1, comprising two lock blocks oppositely disposed wherein said internal threads of said inner walls of each lock block face each other, wherein said each lock block comprises two vertically oriented diagonal slide grooves and wherein said two vertically oriented diagonal slide grooves on said two lock blocks extend downwardly in opposite directions thereby causing said lock blocks to move toward each other when said press plate is depressed.

4. The installation nut according to claim 3, wherein said elastic member for each of said two lock blocks comprises a spring placed vertically in the top of each lock block such that said spring slidably connects with an underside of said press plate but does not connect on said flat seat of said receiving assembly.

5. The installation nut according to claim 1, wherein said receiving assembly further comprises vertical side walls for enclosing said flat seat and vertical tabs for movably connecting said receiving assembly with said press plate.

6. The installation nut according to claim 3, wherein said installation nut is locked into an installed position by manually rotating said main body in a clockwise direction.

7. An installation nut configured to thread with a threaded bolt, comprising:

a main body comprising a through hole, a receiving assembly positioned at the top portion of said main body, said receiving assembly comprising a flat seat, vertical side walls that enclose said flat seat and vertical tabs for movably connecting said receiving assembly with a press plate, a press plate disposed at the top of said main body and movably connected with said receiving assembly, said press plate further comprising at least one vertically oriented diagonal slide, two movable lock blocks oppositely disposed on said flat seat within said receiving assembly, said at least two movable lock blocks each comprising an inner wall having an internal thread, and an outer wall having vertically oriented diagonal slide grooves for slidably receiving said vertically oriented diagonal slides of said press plate, and at least one elastic member for connection of each of said at least two movable lock blocks with an underside of said press plate, wherein when said press plate is depressed, the diagonal slides of said press plate, in conjunction with said diagonal slide grooves in each of said movable lock blocks cause said movable lock blocks to move inwardly towards the axis of said threaded bolt, and wherein said installation nut is installed on said threaded bolt by positioning said threaded bolt with said through hole of said main body and applying upward pressure to said main body until said press plate contacts an underside of a countertop resulting in downward pressure on said press plate such that said lock blocks are moved inwardly until said lock blocks engage external threads of said bolt.

8. The installation nut according to claim 7, wherein said press plate defines an annular structure.

9. The installation nut according to claim 7, wherein said elastic member for each of said two lock blocks comprises a spring placed vertically in the top of each lock block such that said spring slidably connects with an underside of said press plate but does not connect on said flat seat of said receiving assembly.

10. The installation nut according to claim 7, wherein said installation nut is locked into an installed position by manually rotating said main body in a clockwise direction.

* * * * *